US009022495B1

(12) United States Patent
Conner, Sr.

(10) Patent No.: US 9,022,495 B1
(45) Date of Patent: May 5, 2015

(54) REFRIGERATOR WITH ROTATABLE SHELVES

(71) Applicant: Michael E. Conner, Sr., Arvonia, VA (US)

(72) Inventor: Michael E. Conner, Sr., Arvonia, VA (US)

( * ) Notice: Subject to any disclaimer, the term of this patent is extended or adjusted under 35 U.S.C. 154(b) by 108 days.

(21) Appl. No.: 13/648,573

(22) Filed: Oct. 10, 2012

Related U.S. Application Data

(63) Continuation-in-part of application No. 13/182,552, filed on Jul. 14, 2011, now Pat. No. 8,641,158.

(51) Int. Cl.

| | |
|---|---|
| ***A47B 96/04*** | (2006.01) |
| ***A47B 81/00*** | (2006.01) |
| ***F25D 25/02*** | (2006.01) |
| ***A47B 49/00*** | (2006.01) |

(52) U.S. Cl.
CPC ..... *F25D 25/027* (2013.01); *A47B 49/004* (2013.01)

(58) Field of Classification Search
CPC .... F25D 25/027; F25D 49/004; A47B 49/004
USPC ..... 312/408, 405.1, 321.5, 305, 238, 307; 108/50.12
See application file for complete search history.

(56) References Cited

U.S. PATENT DOCUMENTS

| | | | | |
|---|---|---|---|---|
| 1,687,149 | A * | 10/1928 | Shauer et al. | 108/94 |
| 1,732,113 | A * | 10/1929 | Van Der Meer | 248/349.1 |
| 2,403,164 | A * | 7/1946 | Ahrens et al. | 211/153 |
| 4,191,437 | A * | 3/1980 | Funke | 312/305 |
| 5,718,178 | A * | 2/1998 | Smith | 108/25 |
| 2003/0155317 | A1* | 8/2003 | McNeeley et al. | 211/78 |
| 2006/0060744 | A1* | 3/2006 | Caldwell | 248/349.1 |

* cited by examiner

*Primary Examiner* — Daniel J Troy
*Assistant Examiner* — Timothy M Ayres
(74) *Attorney, Agent, or Firm* — Blake P. Hurt

(57) ABSTRACT

A refrigerator is provided with rotatable shelves for easy food/item access and cleaning. In one embodiment a stationary or fixed shelf includes a rotatable disk mounted on a bearing retainer having bearings therein for manual, three hundred sixty degree (360°) rotation as desired. In another embodiment a quarter-round pivotable shelf is attached to a stanchion to enable the shelf to be manually pivoted ninety degrees (90°) for withdrawing and returning the shelf to the refrigerator food storage compartment as needed.

13 Claims, 13 Drawing Sheets

REFRIGERATOR WITH ROTATABLE SHELVES

This is a continuation-in-part of and claims benefits under pending prior application Ser. No. 13/182,552 filed 14 Jul. 2011, now U.S. Pat. No. 8,641,158, which is incorporated by reference in its entirety herein.

FIELD OF THE INVENTION

The invention herein pertains to refrigerators as are used in homes and elsewhere and particularly pertains to a refrigerator having revolving shelves for easy user access.

DESCRIPTION OF THE PRIOR ART AND OBJECTIVES OF THE INVENTION

Convenience and economy have become very important considerations when buying or using household appliances. The household refrigerator is a mainstay and is used perhaps more frequently than other appliances within a typical home. Many food items, particularly small ones are stored within the refrigerator for prolonged periods of time and can become easily lost or hidden as more items are added to the front of a typical refrigerator shelf.

Thus in order to save time in locating a particular item within a refrigerator storage compartment and to prevent duplication or spoilage of stored items, the present invention was conceived and one of its objectives is to provide a refrigerator with a shelf having a rotatable disk which allows the user to easily see and reach all the items stored thereon.

It is another objective of the present invention to provide a refrigerator with a shelf having a rotatable disk mounted on bearings which can be quickly, manually rotated three hundred and sixty degrees (360°) even under a heavy load.

It is still another objective of the present invention to provide a refrigerator shelf with a rotatable disk which can be easily removed for cleaning purposes.

It is still yet a further objective of the present invention to provide a refrigerator shelf with a rotatable disk which is relatively simple and inexpensive to manufacture and install.

It is also another objective of the present invention to provide a refrigerator shelf with a rotatable disk for use in either a side-by-side or upper and lower refrigerator/freezer configuration.

It is yet another objective of the present invention to provide in another embodiment a refrigerator with a pivotable shelf which is affixed to a stanchion within the food storage compartment.

It is a further objective of the present invention to provide a refrigerator with a stanchion attached pivotable shelf having a quarter-round shape for easy shelf withdrawal.

It is also an objective of the present invention to provide a refrigerator with a pivotable shelf which can be manually pivoted outwardly ninety degrees (90°) from inside the refrigerator for access purposes and returned to its former inside position.

It is yet another objective of the present invention to provide a refrigerator with a pivotable shelf which is relatively simple and inexpensive to manufacture and install.

It is still a further objective of the present invention is to provide a refrigerator with grooved strips for slidable shelf insertion.

It is also an objective of the present invention to provide a refrigerator with mountable shelves having rotatable disks therein which can be vertically adjusted through the use of slotted mounting strips affixed to the rear wall of the food compartment.

It is yet a further objective of the present invention to provide a refrigerator shelf with a removable rotatable disk having finger tabs for controlled manual rotation for use in either a side-by-side or upper and lower refrigerator/freezer configuration.

It is still yet another objective of the present invention to provide a refrigerator shelf having a disk which rotatably rests on a removable bearing retainer and race for ease in cleaning.

It is also a further objective of the present invention to provide a circular U-shaped race with a lip for frictional engagement within an opening of a refrigerator shelf for rotatably maintaining a disk thereon.

It is yet a further objective of the present invention to be used in a method for storing and accessing materials stored in the rear of a refrigerator food compartment that would otherwise be inaccessible to a user.

Various other objectives and advantages of the present invention will become apparent to those skilled in the art as a more detailed description is set forth below.

SUMMARY OF THE INVENTION

The aforesaid and other objectives are realized by providing, in one embodiment a refrigerator having a series of circular disks which are each rotatably mounted within a shelf which includes an aperture therein and a shoulder therearound for receiving the disk. The disks are formed from suitable glass or other materials. The disks rest on spherical bearings mounted within a bearing retainer and rotates on the shoulder for ease in use. The disks can be manually rotated three hundred sixty degrees (360°) for selection and deposit or removal of items thereon. The disks and bearing retainers can be quickly removed, cleaned and replaced on the shelf should food spillage occur. The shelves with rotatable disks can be utilized within either side-by-side or lower and upper refrigerator/freezer configurations.

In another embodiment of the invention a cylindrical stanchion is mounted within the food storage compartment of a refrigerator proximate one wall with a series of quarter-round shelves pivotably attached thereto. Each quarter-round shelf is positioned contiguously in a stationary shelf which has a complementary shaped edge to the quarter-round shelf edge. In use, the pivotable shelf can be easily rotated ninety degrees (90°) outwardly from the food storage compartment and items of choice can be removed or placed thereon. Afterwards the shelf is urged back into edge engagement with its particular stationary shelf. The refrigerator door can then be closed as usual. Each quarter-round pivotable shelf consists of a frame surrounding a glass shelf insert. The frames are rotatably mounted on the stanchion and maintained in place by shelf supports.

In another embodiment of the invention a refrigerator is provided with grooved strips for slidably receiving a series of shelves with circular disks rotatably mounted therein.

In still another embodiment of the invention a refrigerator is provided with a pair of vertical mounting strips which are slotted for affixing a series of shelves having circular disks rotatably mounted therein. The shelves have triangular shaped brackets with tabs for insertion into selected slots of the mounting strips for height adjustment.

In yet another embodiment a refrigerator shelf is provided having an aperture therein for receiving a rotatably mounted circular disk. The disk rests on spherical bearings mounted within a bearing retainer and rotates on a removable race positioned within the aperture of the fixed shelf. The disk includes an attached ring having finger tabs which allow for controlled manual manipulation and three hundred sixty degrees (360°) rotation of the disk as needed. The disk, bearing retainer, and race can be quickly, easily removed, cleaned and replaced on the shelf should food spillage occur and can be utilized within either side-by-side or lower and upper refrigerator/freezer configurations.

DETAILED DESCRIPTION OF THE PREFERRED EMBODIMENTS AND OPERATION OF THE INVENTION

Figure 1:
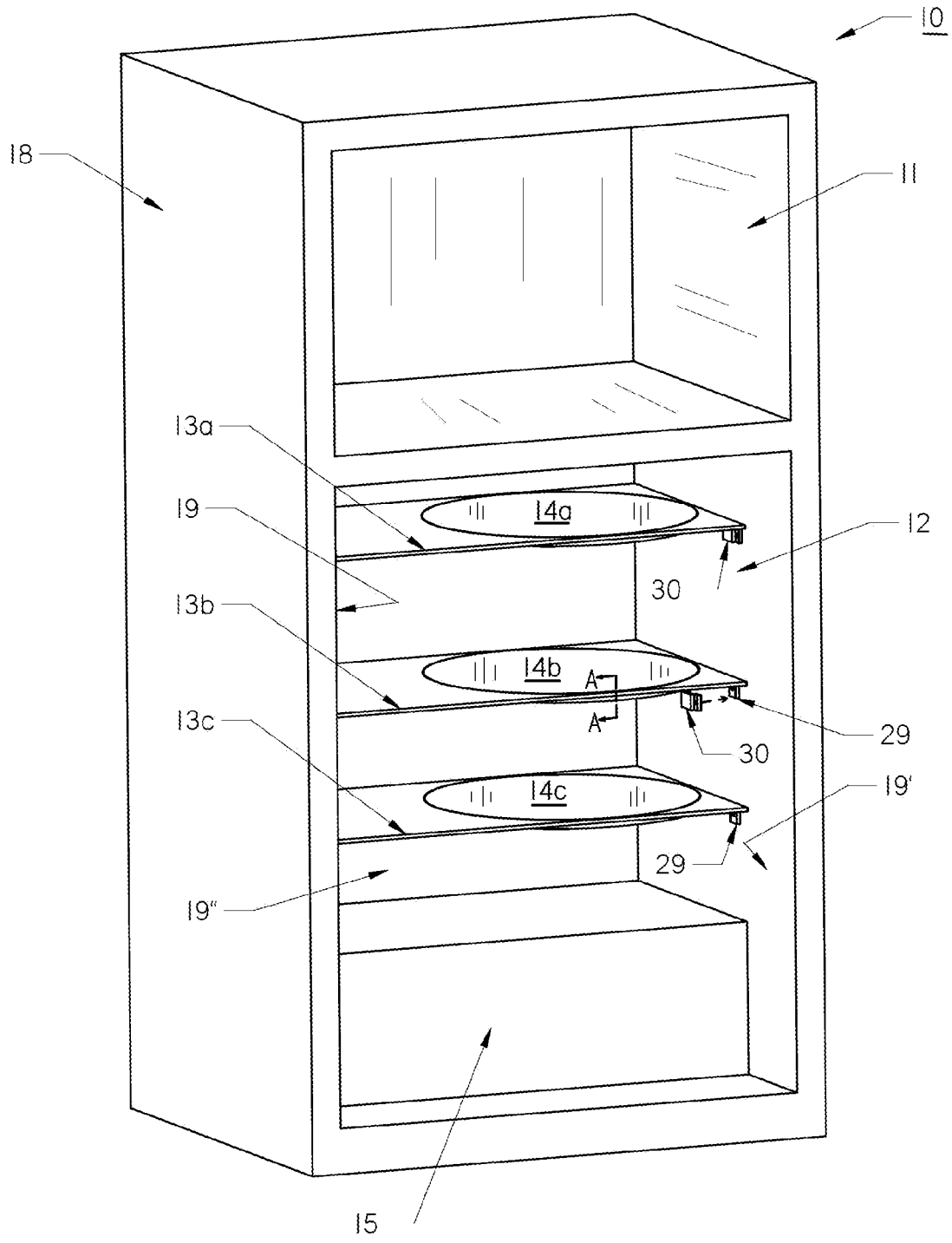
FIG. 1 shows a schematic open view of a typical refrigerator having an upper freezer compartment and lower food storage compartment containing three stationary shelves, with each shelf having a rotatable disk thereon.
Figure 2:
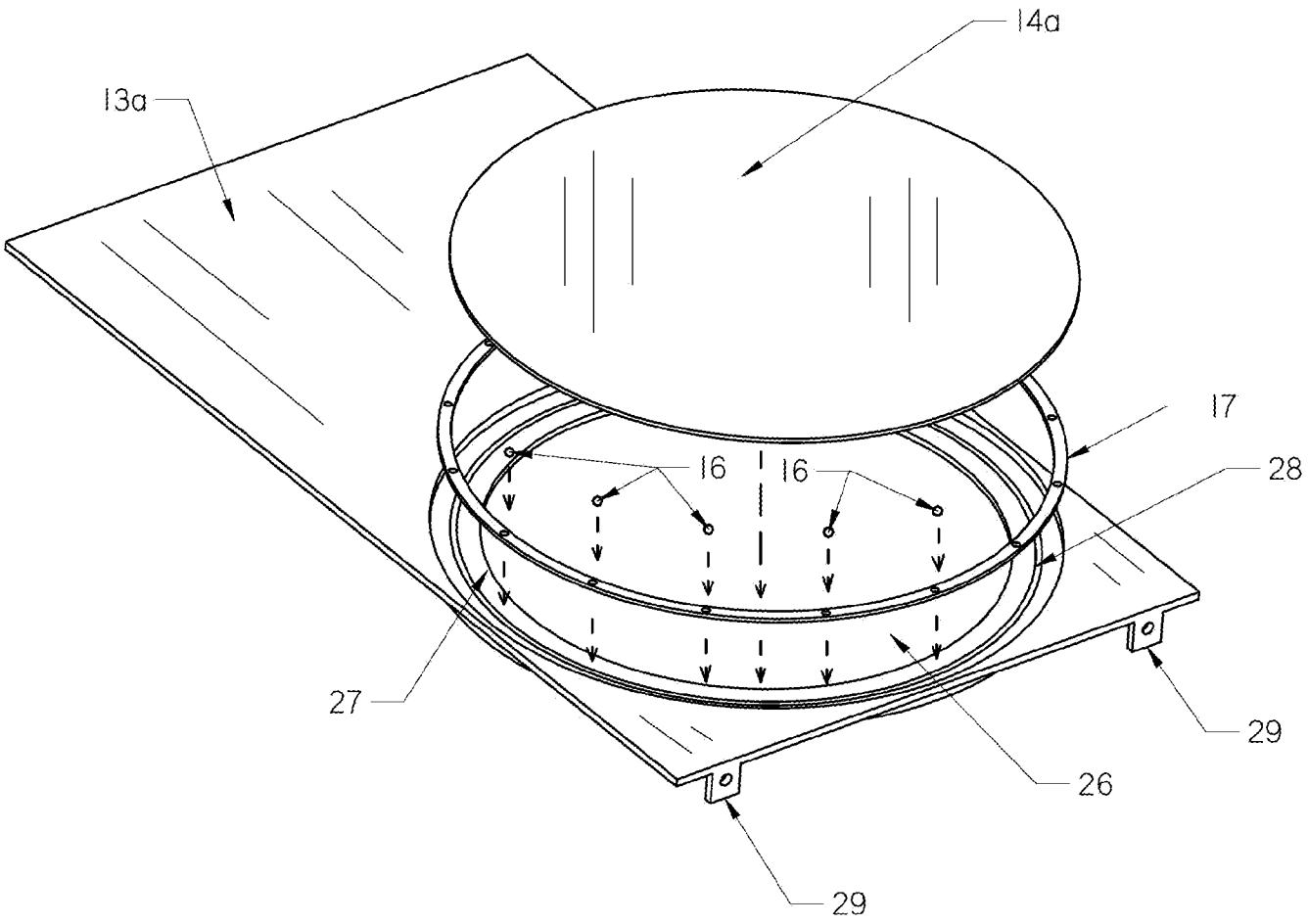
FIG. 2 demonstrates an enlarged exploded view of one of the shelves of FIG. 1 with a rotatable disk removed from the refrigerator.

For a better understanding of the invention and its operation, turning now to the drawings, FIG. 1 demonstrates in schematic representation preferred refrigerator 10 which includes outer housing 18 with top freezer compartment 11, large main food storage compartment 12 and front door opening 15. For simplicity purposes, no doors or other usual components are shown in this schematic view. Housing 18 includes opposing inner side walls 19, 19', inner rear wall 19" and opposing front door opening 15. Food storage compartment 12 has three rectangular shelves 13*a*, 13*b* and 13*c* mounted on side walls 19, 19' as conventional. Shelves 13*a*, 13*b* and 13*c* include respectively, manually rotatable disks 14*a*, 14*b* and 14*c*. Preferably, three rotatable disks are provided on three rectangular shelves as seen, however more or less shelves may be suitable for a particular size refrigerator. Shelves 13*a*, 13*b* and 13*c* each include four (4) mounting tabs 29 as also seen in FIG. 2. Mounting tabs 29 can be attached to inner side walls 19, 19' with standard screws, bolts or fasteners and are preferably, releasably slid into opposing sets of U-shaped brackets 30 as shown in FIG. 1. Brackets 30 which act as pockets for receiving mounting tabs 29 are mounted to each of inner side walls 19, 19' by screws (not shown) or other standard fasteners to allow for quick shelf removal and replacement for cleaning or maintenance purposes. Any number of complementary opposing brackets 30 could be placed at varying heights on side walls 19, 19' for lowering or raising shelves 13*a*, 13*b* and 13*c* as needed to accommodate for taller or shorter food items.

In FIG. 2, enlarged shelf 13*a* is seen removed from refrigerator 10 with rotatable glass disk 14*a*, bearings 16 and bearing retainer 17, all shown in exploded fashion. Shelf 13*a* includes circular shelf shoulder 27 which has a depth of approximately one-half inch (12.7 cm) surrounding large central aperture 26. Shoulder 27 is sized for maintaining bearing retainer 17 with bearings 16 therein and includes groove 28 therearound for receiving bearings 16. Rotatable disk 14*a* rests atop bearings 16 in bearing retainer 17 to provide a flush, planar surface between the top surface of rotatable disk 14*a* and the top surface of shelf 13*a* as better seen in FIG. 2A. Shoulder 27 includes bearing groove or track 28 therearound for receiving bearings 16, providing ease in rotational movement and to maintain centering of rotatable disk 14*a* in relation to fixed shelf 13*a* (FIG. 1). Rotatable disk 14*a* which is preferably formed from glass rotates three hundred sixty degrees (360°) on a plurality of stainless steel bearings 16 which are held by circular shaped bearing retainer 17. Rotatable disk 14*a* includes circular, peripheral groove 33 (FIG. 2A) around the edge on the bottom surface for receiving bearings 16 to likewise provide a track for ease in rotational movement and maintaining true centering in relation to stationary shelf 13*a*. Bearings 16 allow for easy manual rotation of disk 14*a* on bearing retainer 17 within stationary shelf 13*a*. Bearings 16 are generally termed "ball transfers" in the trade and are commonly manufactured from steel, stainless steel, nylon or other suitable materials. Bearing retainer 17 is preferably formed from plastic but could be formed from a suitable material such as stainless steel or the like. As would be understood shelves 13*b* and 13*c* with respective disks 14*b* and 14*c* are formed and operate identical to shelf 13*a* and disk 14*a* as described above.

Figure 2A:
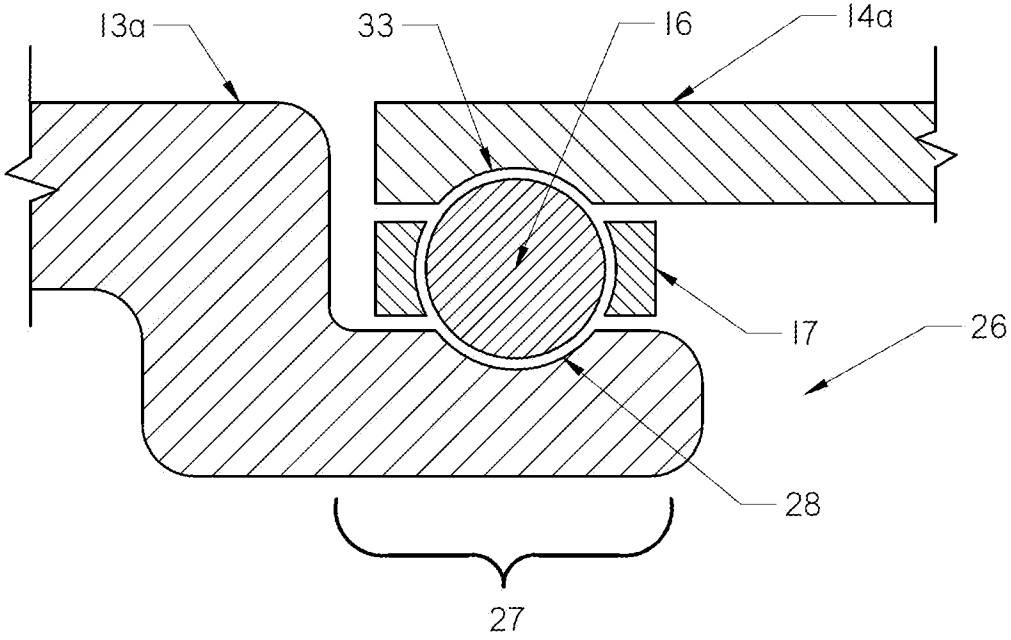
FIG. 2A depicts an enlarged cross-sectional view of the shelf edge as along lines A-A of FIG. 1.

FIG. 2A demonstrates in enlarged cross-sectional appearance one edge of assembled shelf 13*a* and rotatable disk 14*a* mounted on bearing 16 in bearing retainer 17 as along lines A-A of FIG. 1. Preferred disk 14*a* can be formed from suitable glass but plastics or other desirable materials may also be used. Disk 14*a* has a diameter as shown in FIG. 2 of approximately seventeen and three quarter inches (45 cm) with a thickness of approximately one-quarter inch (1.635 cm). Shelf 13*a* has a length of approximately thirty-two inches (81.28 cm) to span the typical width of food compartment 12 and a width of approximately eighteen and one-quarter inches (46.35 cm). Mounting tabs 29 are rectangular and have a width of approximately three-quarters of an inch (1.9 cm) and include an aperture therein for receiving conventional screws, bolts or the like (not shown) for attachment of shelves 13*a*, 13*b* and 13*c* to inner side walls 19, 19' within housing 18. As would be understood, two pair of opposing mounting tabs 29 are on each shelf, but only one pair are shown in FIG. 2.

Figure 3:
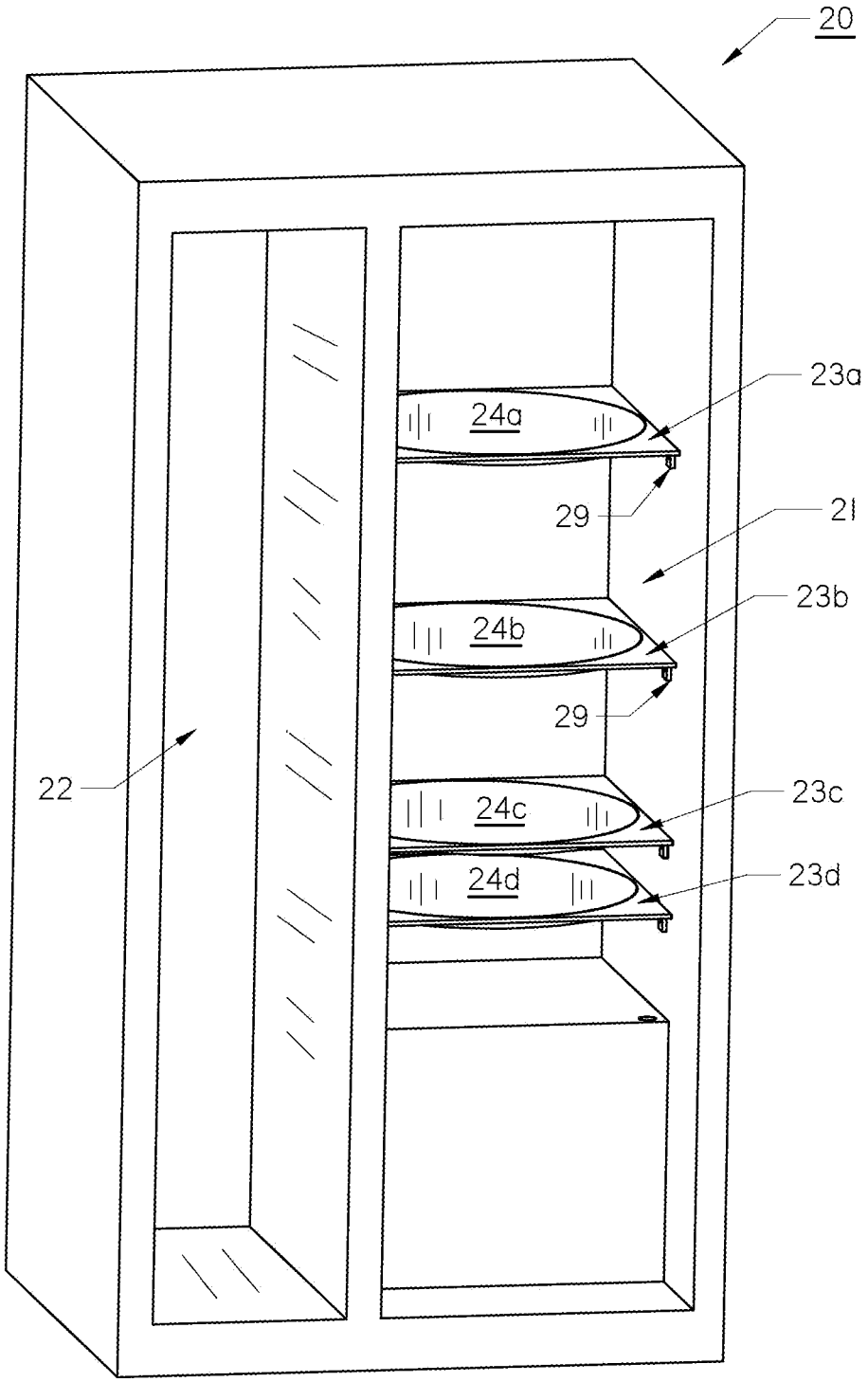
FIG. 3 illustrates a schematic open view of a typical side-by-side refrigerator/freezer having four stationary shelves, with each shelf having a rotatable disk thereon.

In an alternate embodiment seen in schematic illustration in FIG. 3, side-by-side refrigerator 20 is shown having food storage compartment 21 and freezer compartment 22, both without doors and other conventional components for illustration purposes. Food storage compartment 21 includes four rotatable disks 24*a*, 24*b*, 24*c* and 24*d* maintained respectively on four stationary shelves 23*a*, 23*b*, 23*c* and 23*d*. Rotatable disks 24*a*, 24*b*, 24*c* and 24*d* each include a groove 33 on the bottom surface thereof and rotate three hundred and sixty degrees (360°) on bearing retainer 25 having bearings 16 therein as earlier described regarding disks 14*a*, 14*b* and 14*c* of FIGS. 1, 2 and 2A. Stationary shelves 23*a*, 23*b*, 23*c* and 23*d* with rotatable disks 24*a*, 24*b*, 24*c* and 24*d* operate and are formed identically to stationary shelves 13*a*, 13*b* and 13*c* with rotatable disks 14*a*, 14*b* and 14*c* (FIG. 1), however the length and width dimensions are smaller for placement within typical side-by-side refrigerator 20. Further, four rotatable disks are provided in four rectangular shelves as seen, however more or less shelves may be suitable for a particular refrigerator.

Figure 4:
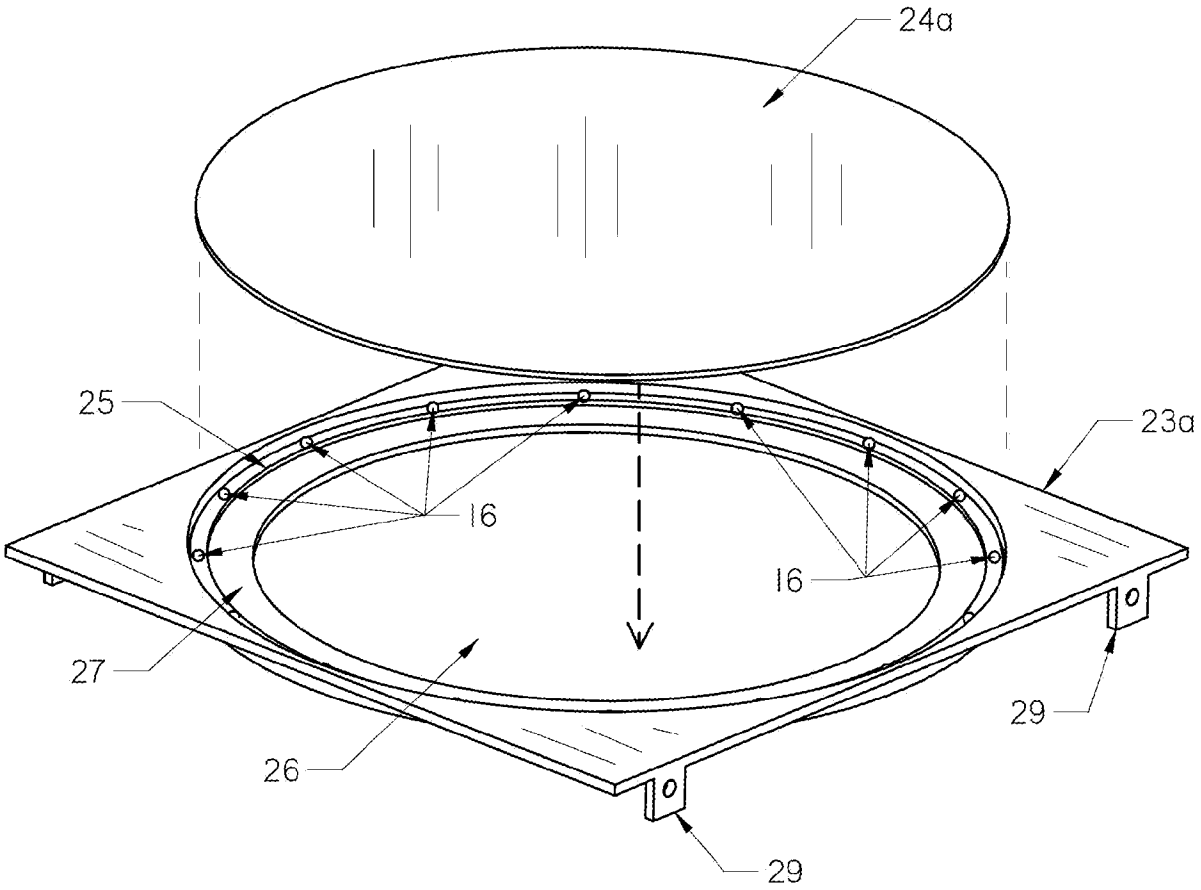
FIG. 4 pictures an enlarged exploded view of one of the shelves as seen in FIG. 3 removed from the refrigerator.

In FIG. 4 stationary shelf 23*a* with large central aperture 26 is seen removed from refrigerator 20 with rotatable disk 24*a* exploded therefrom. Disk 24*a* is similar to disk 14*a* of FIG. 1 as shelf 23*a* includes stainless steel bearing retainer 25 in shelf shoulder 27. Bearing retainer 25 maintains bearings 16 upon which disk 24*a* rotates three hundred sixty degrees (360°) as earlier described for disk 14*a*. Mounting tabs 29 are likewise seen on shelf 23*a* which are conventionally attached to the inside of the side walls of food storage compartment 21 such as by screws, bolts or the like (not shown).

Figure 5:
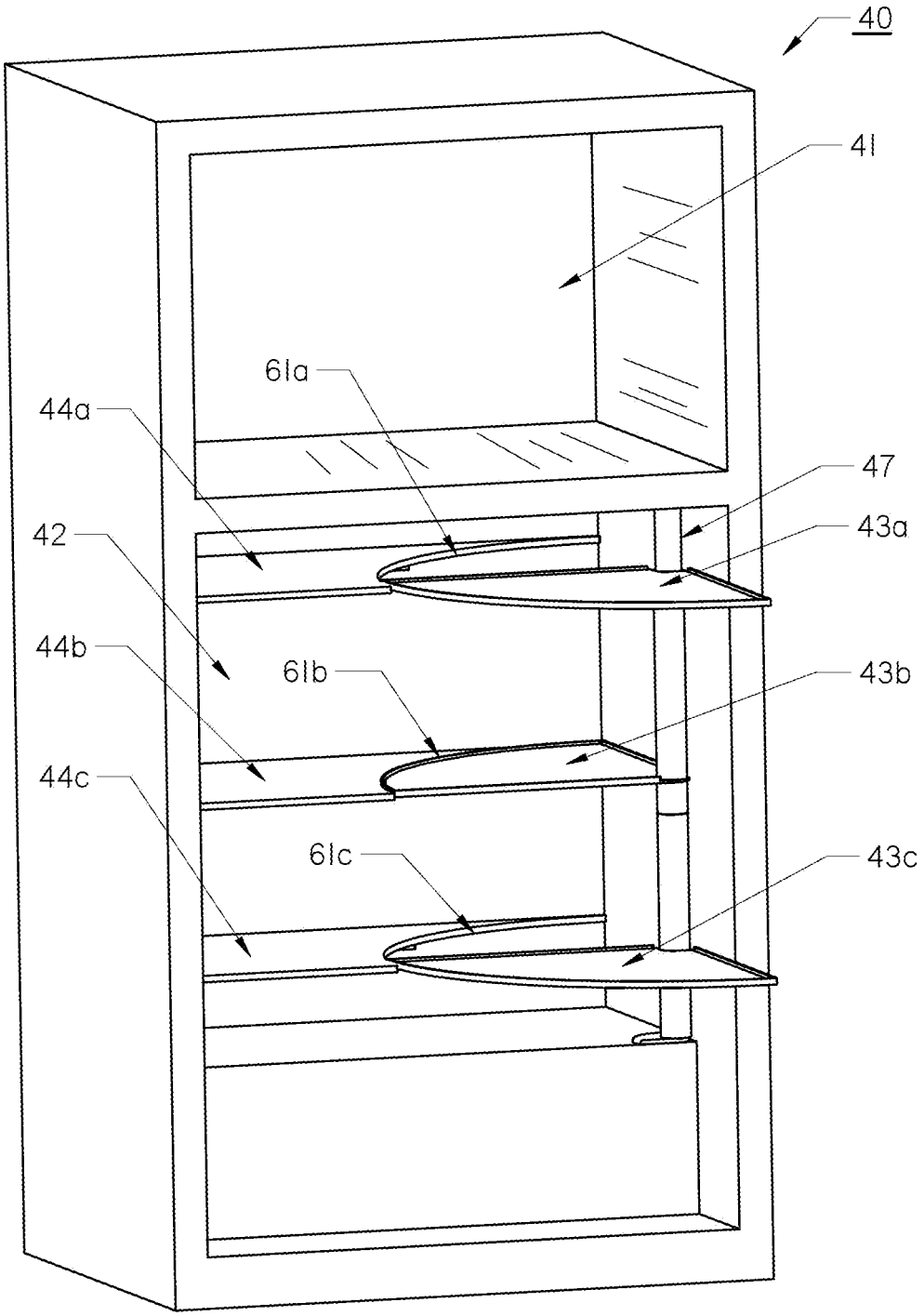
FIG. 5 shows a second embodiment of a refrigerator seen in schematic, open fashion having three pivotable quarter-round shelves affixed to a stanchion with two of the shelves shown extending outwardly from the refrigerator.

In another alternate embodiment of the invention as schematically illustrated in FIG. 5, refrigerator 40 includes top freezer compartment 41 and bottom food storage compartment 42. For simplicity purposes, no doors, or other components are shown. Three pivotable quarter-round shelves 43*a*, 43*b* and 43*c* are mounted on cylindrical stanchion 47 with respective complementary stationary shelves 44*a*, 44*b* and 44*c* maintained within food storage compartment 42. Shelves 43*a* and 43*c* are shown pivoted about ninety degrees (90°) from their dormant position inside food storage compartment 42 and extend outwardly for easy reach of food or other items (not shown) contained thereon. Pivotable shelves 43*a*, 43*b* and 43*c* may be preferably constructed of glass however plastic, metal or the like may be used. Pivotable shelves 43*a*, 43*b* and 43*c* when closed engage respectively complementary edges 61*a*, 61*b* and 61*c* of shelves 44*a*, 44*b* and 44*c* to form a rectangular shaped shelf. Shelves 44*a*, 44*b* and 44*c* each are rigidly affixed to the side and rear walls of refrigerator 40 such as by mounting tabs 29 (not seen in FIG. 5) as hereinbefore described.

Figure 6:
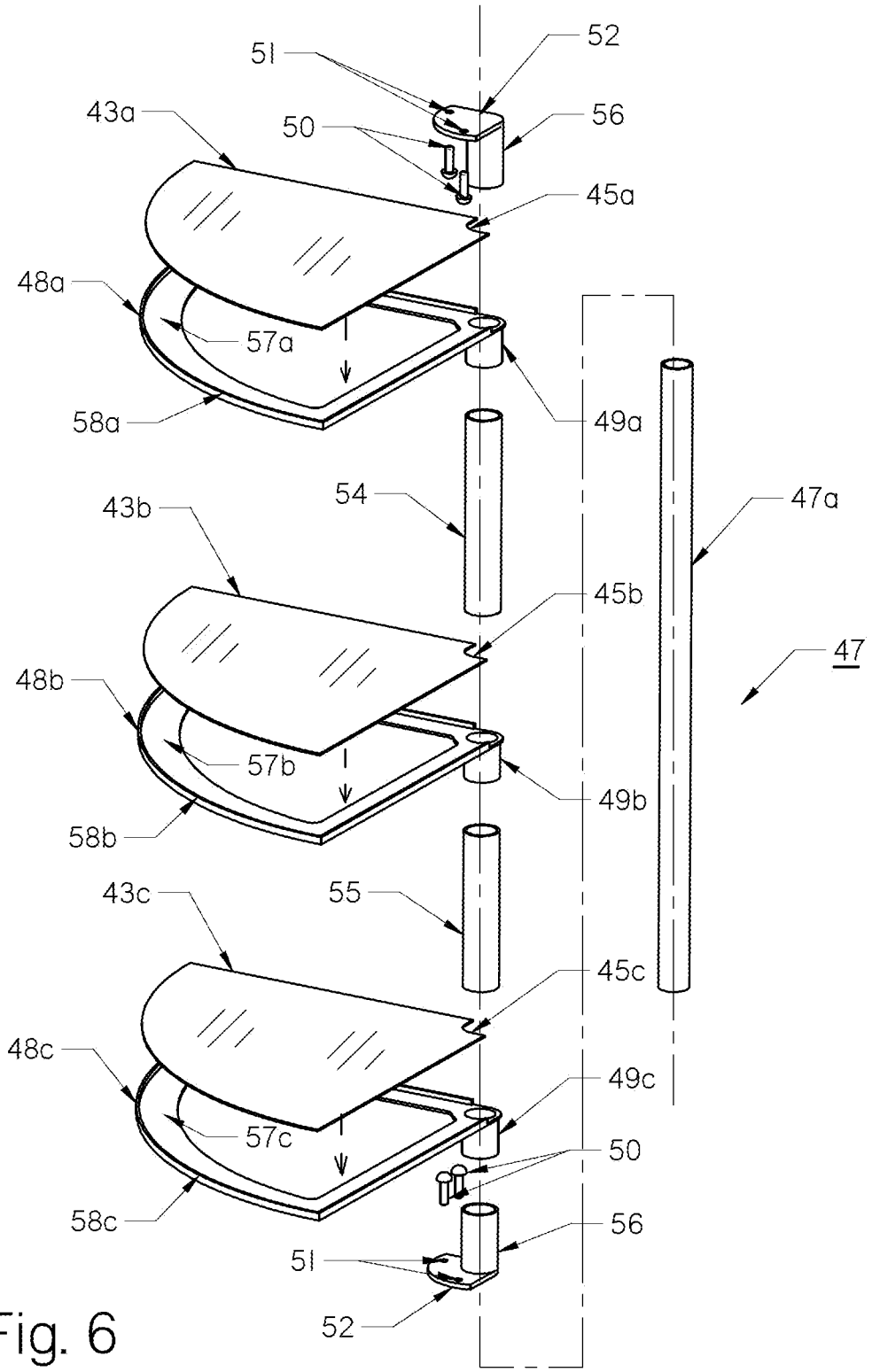
FIG. 6 depicts an enlarged, exploded view of the stanchion and pivotable shelves of FIG. 5 removed from the refrigerator.

Stanchion 47, enlarged in FIG. 6 may be for example one and one-half inches (3.81 cm) in diameter and extends the full height of food storage compartment 42. Stanchion 47 includes cylindrical core 47*a* which is assembled inside of stanchion mounts 56, 56', cylindrical supports 49*a*, 49*b* and 49*c* and shelf supports 54, 55. Cylindrical core 47*a* has a diameter slightly smaller to allow free rotation of shelves 43*a*, 43*b* and 43*c*. Stanchion 47 is mounted by screws, bolts or the like such as by machine bolts 50 (FIG. 6) which pass through apertures 51 in stanchion mounting ears 52 affixed to cylindrical stanchion mounts 56, 56' positioned in opposing fashion on each end for mounting within refrigerator 40. Shelves 43*a*, 43*b* and 43*c* rest on and are pivotably affixed to stanchion 47 by respectively frames 48*a*, 48*b* and 48*c* which consist preferably of flat stainless steel shoulders 57*a*, 57*b* and 57*c* and upright flanges 58*a*, 58*b* and 58*c*. Frames 48*a*, 48*b* and 48*c* are rigidly joined such as by friction to the outer edges of shelves 43*a*, 43*b* and 43*c* respectively. Frames 48*a*, 48*b* and 48*c* are joined to respectively cylindrical supports 49*a*, 49*b* and 49*c*. Shelf supports 54, 55 act as spacers and separate shelf 43*a* from shelf 43*b* and shelf 43*b* from shelf 43*c* respectively on stanchion 47. Shelves 43*a*, 43*b* and 43*c* each include respectively quarter-round cutouts 45*a*, 45*b* and 45*c* proximate supports 49*a*, 49*b* and 49*c* for clearance of stanchion 47 within supports 49*a*, 49*b* and 49*c* of frames 48*a*, 48*b* and 48*c* respectively. As would be understood shelf supports 54, 55 are formed of a rigid material and could be formed shorter or longer to provide variations for differences in shelf heights. Stanchion core 47*a* is mounted within shelf supports 54, 54, cylindrical supports 49*a*, 49*b* and 49*c* and stanchion mounts 56, 56' upon assembly forming stanchion 47 with pivotable shelves 43*a*, 43*b* and 43*c* as seen in FIG. 5.

As further shown in FIG. 6, shelves 43*a*, 43*b* and 43*c* are quarter-round shaped shelves for easy access and each pivots approximately ninety degrees (90°) outwardly from food storage compartment 42. Quarter-round shelves 43*a*, 43*b* and 43*c* allow food or other items (not shown) placed to the rear to be easily reached and accessed by the homeowner by simply pivoting the shelf from an inside to an outside position as shown by shelves 43*a* and 43*c* in FIG. 5. Once the user is finished, the specific outwardly pivoted shelf can be manually pivoted ninety degrees (90°) and returned to its initial inward position within the refrigerator contiguous its complementary stationary shelf as seen by shelf 43*b* and stationary shelf 44*b*. As shown, three pivotable shelves mounted on a stanchion are provided with three complementary stationary shelves, however more or less pivotable/stationary shelf configurations may be suitable for a particular designed refrigerator.

Figure 7:
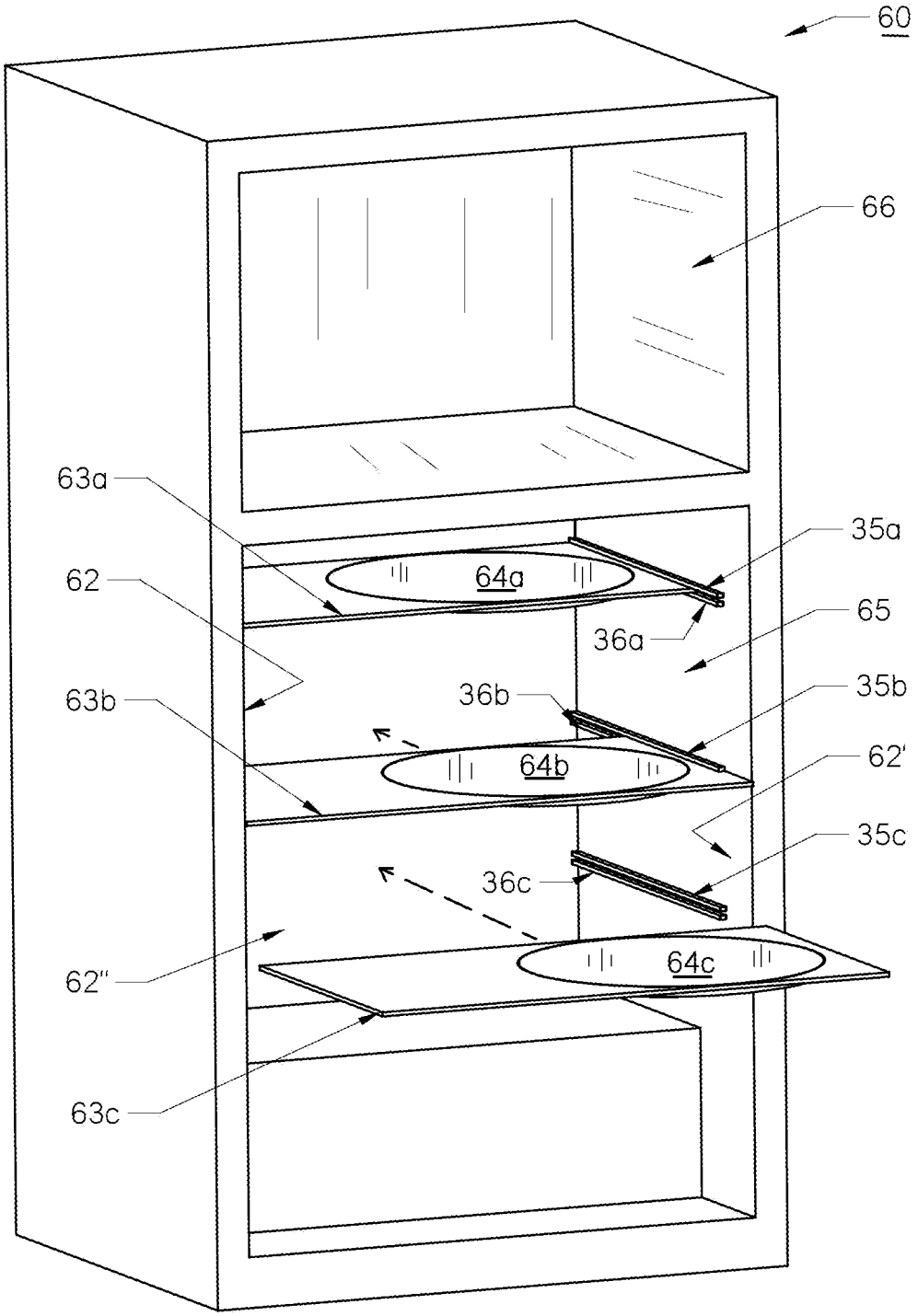
FIG. 7 shows another embodiment of a refrigerator seen in schematic, open fashion having three shelves each with a rotatable disk thereon and slideably received within the food storage compartment.

In another alternate embodiment of the invention as shown in schematic representation in FIG. 7, refrigerator 60 is shown open without doors attached having food storage compartment 65 with inner side walls 62, 62' and rear wall 62" below freezer compartment 66. Rotatable disks 64*a*, 64*b* and 64*c* are positioned on removable shelves 63*a*, 63*b* and 63*c* which operate identically and are formed the same way as stationary shelves 13*a*, 13*b* and 13*c* however, without mounting tabs as seen in refrigerator 10 of FIG. 1. Grooved strips 35*a*, 35*b* and 35*c* are affixed such as by screws or other standard fasteners (not shown) to inner side wall 62' of food storage compartment 65. Although not shown a complementary, directly opposing set of grooved strips 35*a*, 35*b* and 35*c* are affixed to inner side wall 62. Grooved strips 35*a*, 35*b* and 35*c* include respectively, channels 36*a*, 36*b* and 36*c* for receiving respectively shelves 63*a*, 63*b* and 63*c*. Shelves 63*a*, 63*b* and 63*c* have a thickness which allows them to be easily slid into respective channels 36*a*, 36*b* and 36*c*. Shelf 63*b* is shown partially extended from refrigerator 60 while shelf 63*c* is shown fully removed from grooved strips 35*c* such as for cleaning purposes. Grooved strips 35*a*, 35*b* and 35*c* are formed from aluminum or other suitable materials. Complementary opposing grooved strips 35*a*, 35*b* and 35*c* are placed at heights along side walls 62, 62' for lowering or raising a particular shelf as needed.

Figure 8:
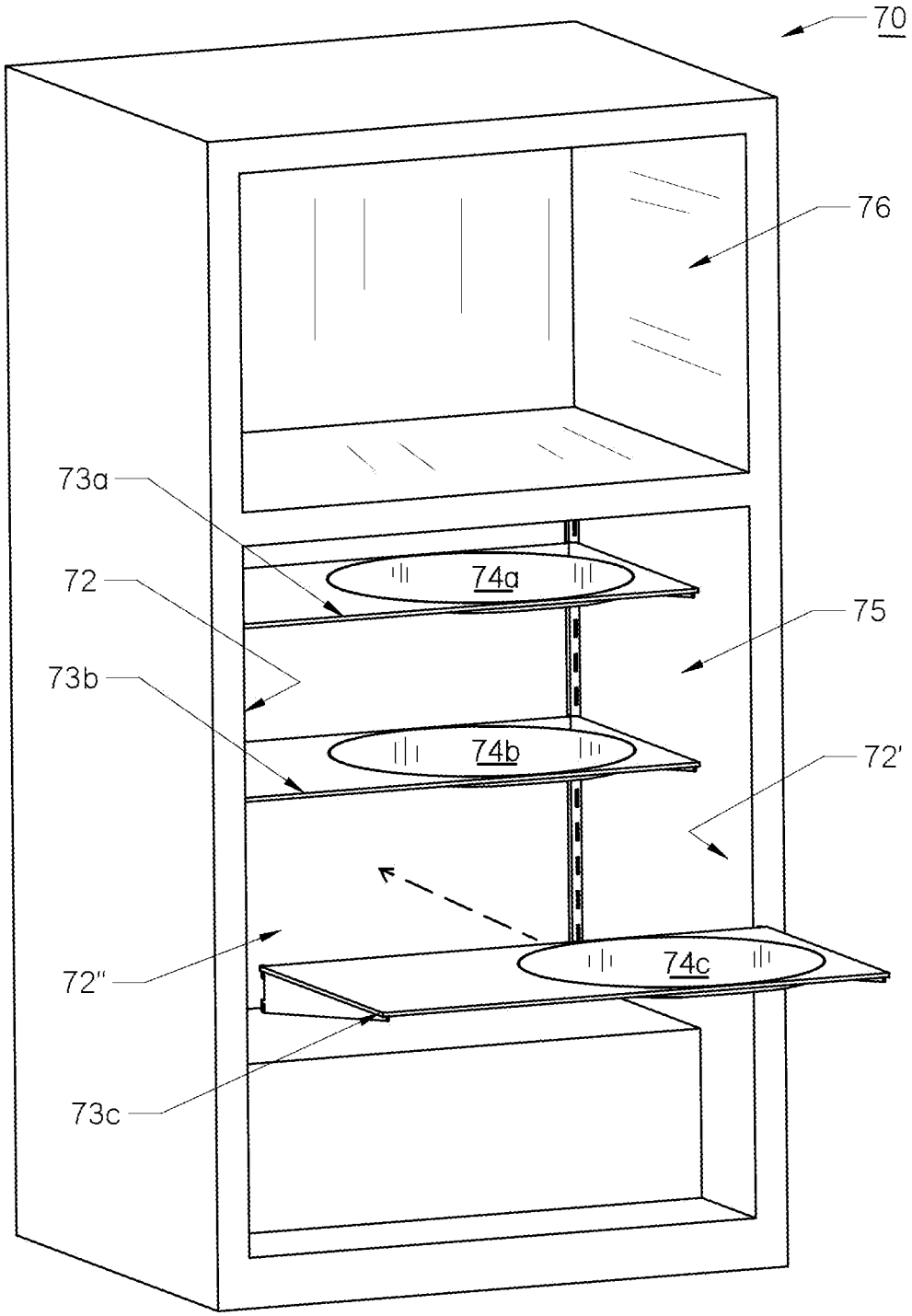
FIG. 8 demonstrates a further embodiment of a refrigerator seen in schematic, open fashion having three shelves each with a rotatable disk thereon and mounted to standard mounting strips within the food storage compartment.
Figure 9:
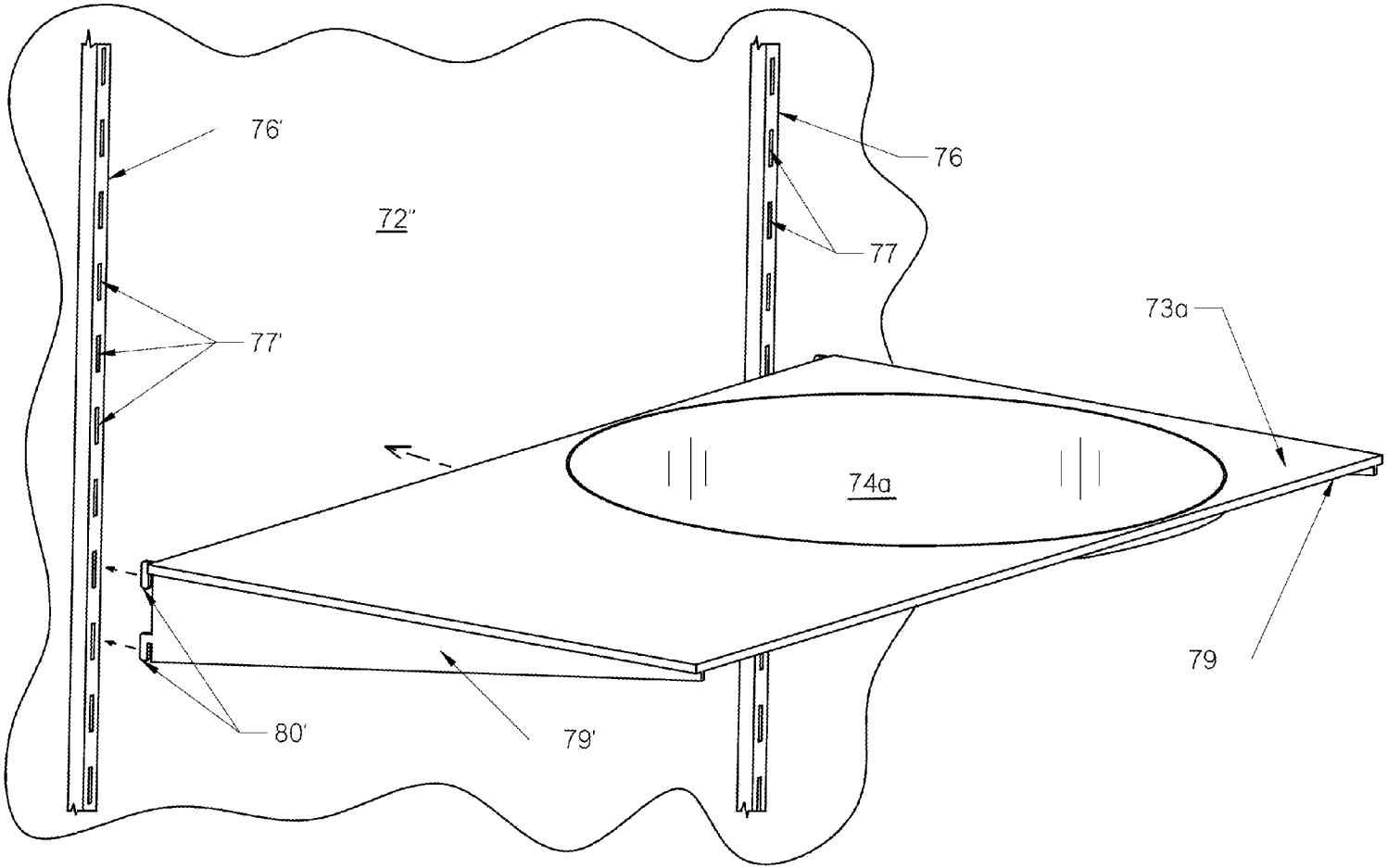
FIG. 9 illustrates an enlarged exploded view of one of the shelves as seen in FIG. 8 removed from the refrigerator prior to mounting.

In another alternate embodiment of the invention, refrigerator is schematically shown in FIG. 8 with open upper freezer compartment 76 and lower food compartment 75. Shelves 73*a*, 73*b* and 73*c* are fully inserted into food compartment 75 and are mounted on vertical strips 76, 76' as shown in fragmented fashion in FIG. 9. Strips 76, 76' are affixed to rear refrigerator wall 72" by conventional screws, bolts, adhesives or other standard fasteners. Strips 76, 76' are conventional and contain slots 77, 77' respectively for height adjustment of for example shelf 73*a* as shown in FIG. 9. Shelf

73*a* includes a pair of opposing triangular shaped shelf brackets 79, 79' affixed on each side which include respectively a pair of mounting tabs 80, 80' (tabs 80 not shown). Rotatable disk 74*a* is mounted to shelf 73*a* in the same manner as disk 14*a* of shelf 13*a* seen in FIG. 1. Shelf brackets 79, 79' include L-shaped mounting tabs 80, 80' which engage slots 77, 77' as seen in FIG. 9. As conventional, shelves 73*a*, 73*b* and 73*c* can be lifted and directed from mounting strips 76, 76' for movement and vertical shelf adjustment. Shelf brackets 79, 79' are formed from aluminum or other conventional materials.

Figure 10:
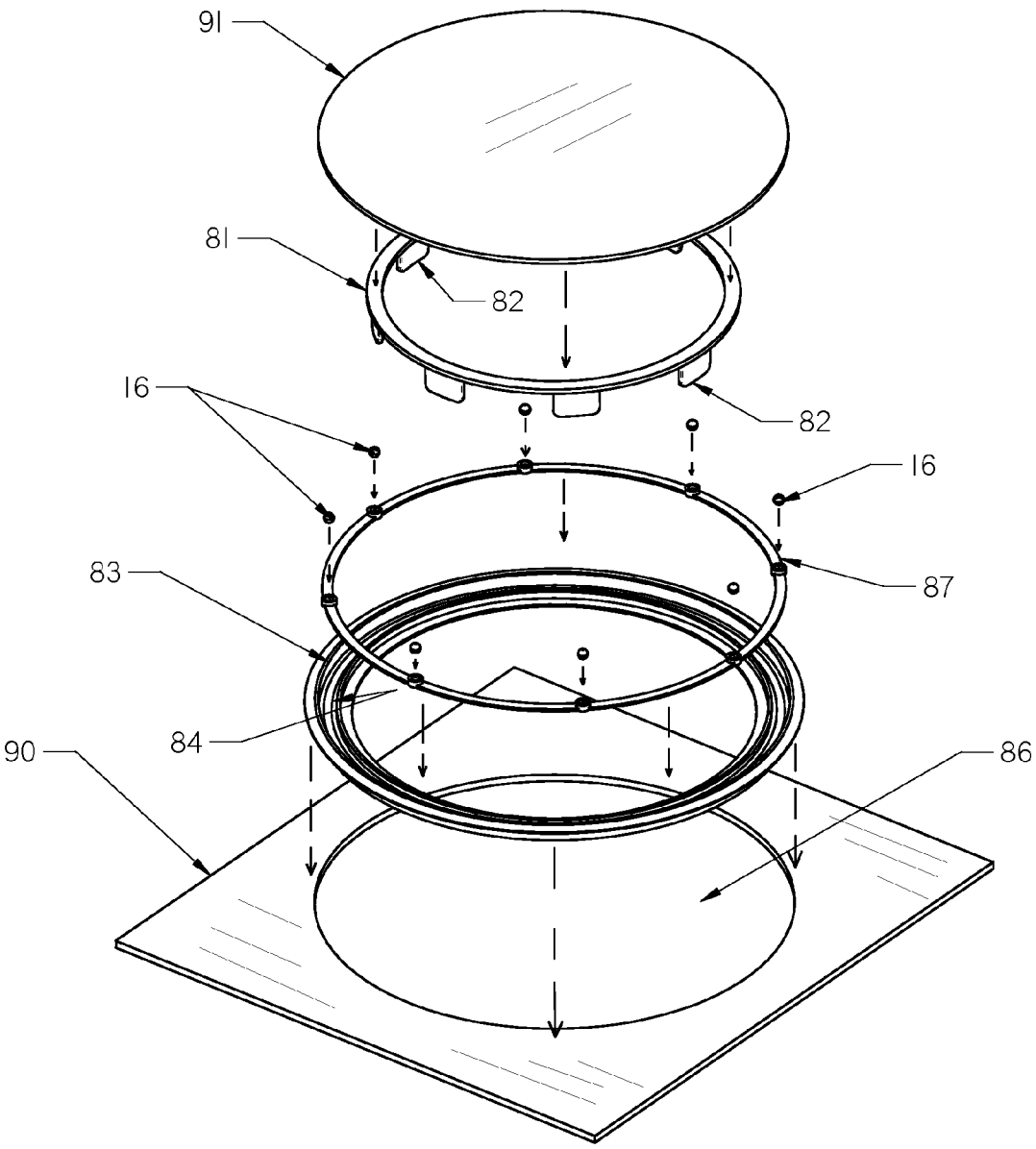
FIG. 10 pictures an exploded view of an alternate embodiment of the shelf of FIG. 3.

FIGS. 10-13 depicts shelf 90 with rotatable disk 91 which is an alternate embodiment of shelves 23*a*-23*d* illustrated in FIGS. 3-4. In FIG. 10, shelf 90 is seen in exploded fashion and removed from a refrigerator such as refrigerator 20. As would be understood due to the variety of attachment means for positioning a shelf within a refrigerator no such means are shown with shelf 90 for simplicity. Further, shelf 90, although shown sized for a side-by-side refrigerator or half shelf could be sized for a full size refrigerator such as seen by shelves 13*a*-13*c* in FIGS. 1-2.

Figures 12, 13:
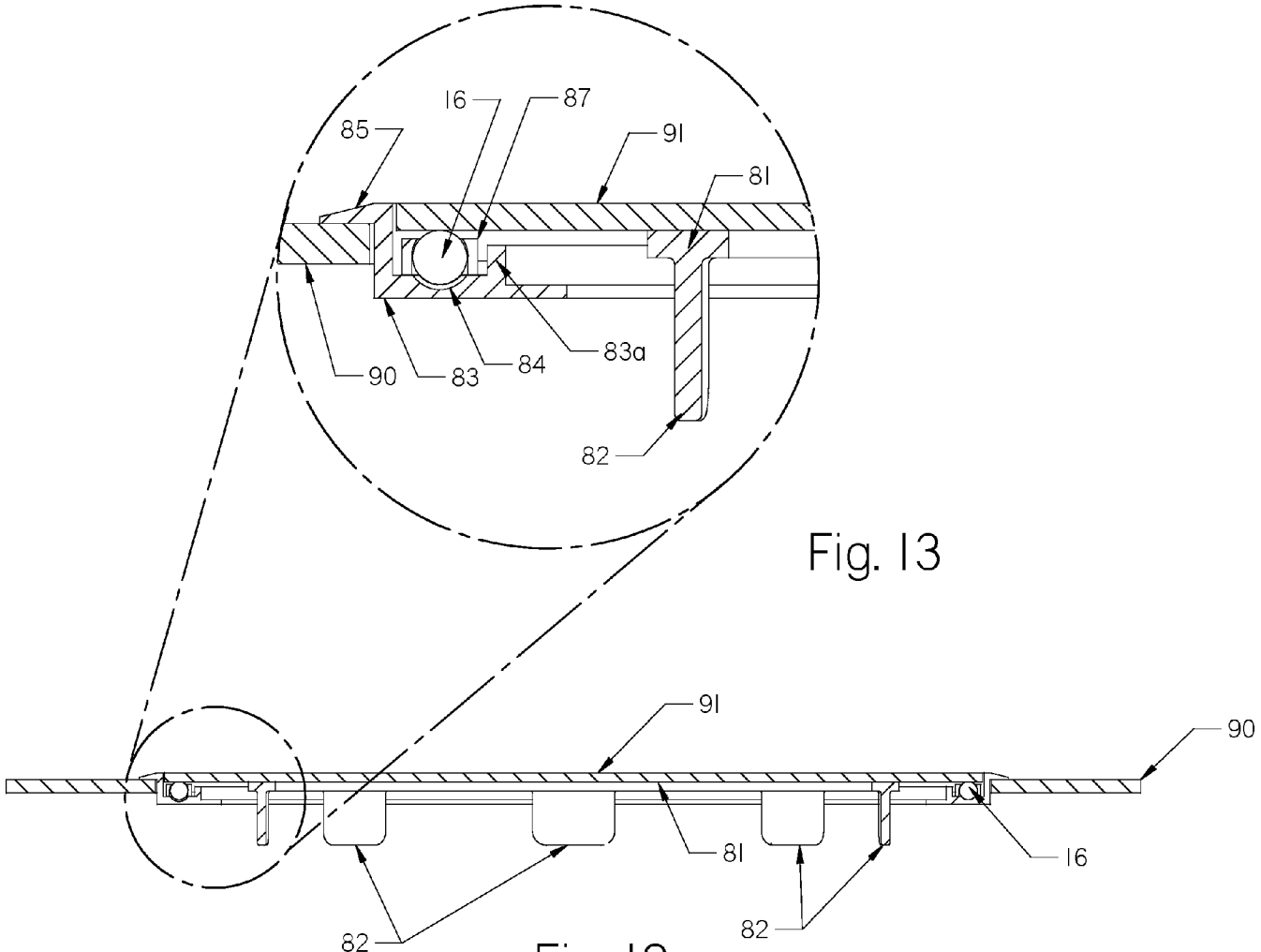
FIG. 12 depicts a cross-sectional view of the alternate embodiment shelf as shown along lines 12-12 in FIG. 11.
FIG. 13 demonstrates an enlarged partial cross-sectional view of the alternate embodiment shelf as shown in FIG. 12.

As shown in FIG. 10, shelf 90 includes aperture 86, race 83 bearing retainer 87, bearings 16, ring 81 with finger tabs 82 and rotatable glass disk 91. Aperture 86 is centrally formed in shelf 90 and is sized to receive race 83 therein as also shown in FIGS. 12 and 13. Race 83 as shown cross-sectioned and partially exploded in FIG. 13, is U-shaped and includes lip 85 which rests atop shelf 90 on one side and shoulder 83*a* on the opposing side with annular groove 84 centrally therebetween. Race 83 when in place frictionally engages shelf 90 to provide a snug fit and prevent any movement therebetween. Lip 85 has a gradual downward sloping edge which meets with shelf 90 to provide for a subtle, smoother transition between disk 91 and shelf 90. Annular groove 84 provides ease in rotational movement and assists with lip 85 to maintain centering of rotatable disk 91 in relation to fixed shelf 90. Race 83 is sized to receive bearing retainer 87 which includes bearing mounts (not shown) spaced therealong for rotatably maintaining bearings 16 therearound. Bearing retainer 87 is mounted in race 83 whereby bearings 16 are positioned on and move within annular groove 84 of race 83. Ring 81 preferably includes one or more finger tabs 82 that are used to control and manually rotate disk 91 when ring 81 is affixed thereto, for example with double-sided adhesive (not shown). Disk 91 is mounted on bearings 16 so that when finger tabs 82 of ring 81 are rotated, disk 91 turns smoothly so as not to upset any items (not shown) resting on disk 91. Although finger tabs 82 are shown with a slightly curved vertically extending shaft for ease in grasping and finger manipulation as would be understood various shapes such as a cylindrical shaft, pyramidal shape or the like could also be utilized with ring 81.

Figure 11:
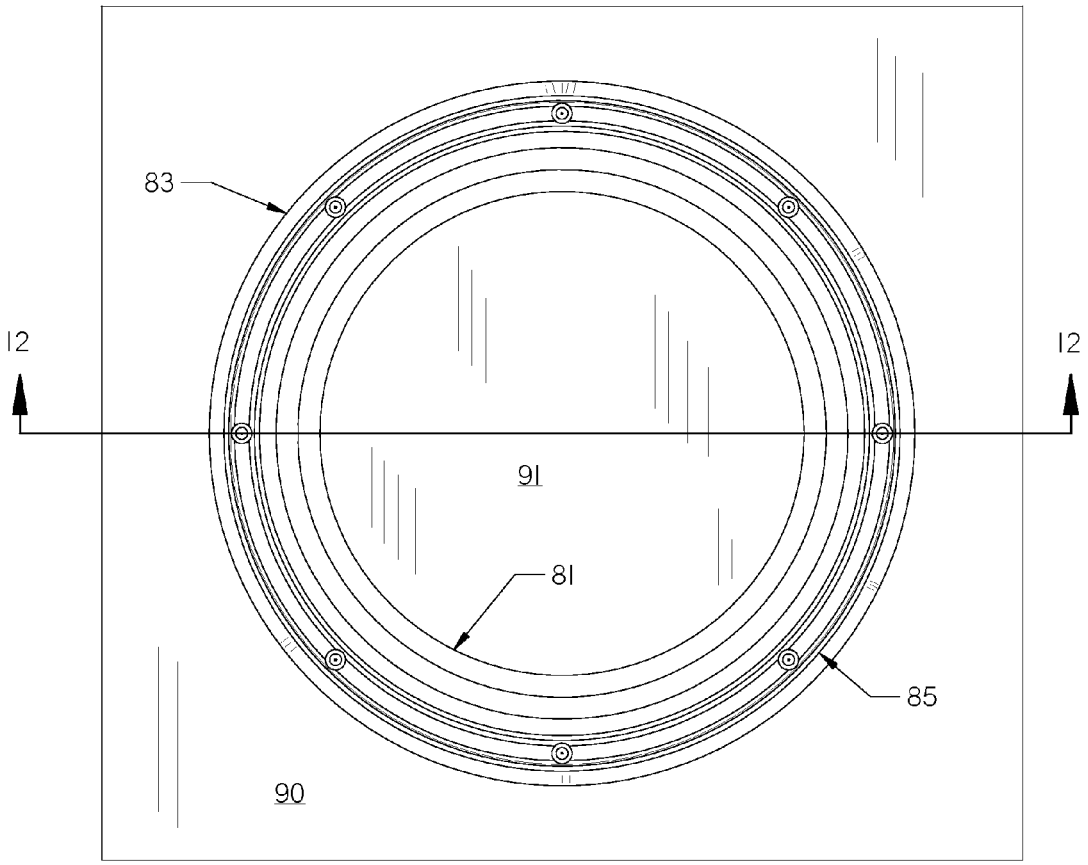
FIG. 11 shows a top plan view of the alternate embodiment shelf pictured in FIG. 10.

FIG. 11 shows a top plan view of shelf 90 while FIG. 12 depicts a cross-sectional view as shown along lines 12-12 in FIG. 11. When properly assembled tabs 82 extend down past race 83 below shelf 90 and are available for manual manipulation by a user (not shown) for rotation of disk 91, for example to view items that are positioned closer to the back of refrigerator 20. FIGS. 11 and 12 illustrate the positioning of disk 91 which extends beyond both ring 81 and bearing retainer 87 but does not contact lip 85 (FIG. 13) of race 83.

FIG. 13 is an enlarged view of a portion of FIG. 12. Race 83 defines lip 85 that extends vertically to be level or coplanar with disk 91 and then slopes to descend downwardly in a tapered fashion forming a ramp-like shape which engages shelf 90. This shape prevents items (not shown) from passively moving onto disk 91 in the event that refrigerator 20 is jostled while maintaining the ease of sliding items off disk 91 if a user so desires.

The assembly of shelf 90 allows race 83, bearing retainer 87 with bearings 16 and ring 81 with disk 91 to easily be removed and disassembled for cleaning purposes as needed versus removing the entire shelf from the refrigerator. Further, as would be understood, ring 81 with finger tabs 82 was added to assist with the gradual movement and controlled manipulation of disk 91 however disk 91 could still be operated without the attachment of ring 81.

A method of storing and accessing materials within a refrigerator is also provided. The preferred method includes the step of providing a refrigerator such as refrigerator 20 with a food storage compartment and a shelf such as shelf 90 having a central circular aperture or opening 86 formed therein. Shelf 90 extends across the food storage compartment (not shown) and includes circular race 83 defining annular groove 84, bearing retainer 87, bearings 16, ring 81 having finger tabs 82 extending downwardly on the bottom thereof and rotatable disk 91 affixed to the top of ring 81. Race 83 is positioned within aperture 86 of shelf 90 and receives bearing retainer 87 therein. Bearings 16 are rotatably positioned within bearing mounts formed within bearing retainer 87 and move within annular groove 84 of race 83 during rotation. Rotatable disk 91 is affixed to ring 81 such as by a double-sided adhesive (not shown) and rests atop bearings 16 in bearing retainer 87 such that disk 91 can be rotated by manipulation of finger tabs 82. The method further includes the step of placing materials to be stored in the refrigerator on disk 91 and the step of rotating disk 91 to access materials (not shown) which were previously proximate the rear of the food storage compartment. The method may further include the step of manually manipulating finger tabs 82 positioned on ring 81 to rotate disk 91.

All embodiments provide convenience to the user for accessing a particular item within a refrigerator when the shelves are full and it is troublesome to remove all the items on a shelf in order to reach a particular small item which has been pushed to the back to accommodate all other items stored within the food storage compartment. Each embodiment is also relatively easy to clean and maintain.

The illustrations and examples provided herein are for explanatory purposes and are not intended to limit the scope of the appended claims.

I claim:

1. A refrigerator with a shelf and rotatable disk comprising: a housing, a food storage compartment, said food storage compartment positioned within said housing, said food storage compartment defining opposing side walls, a rear wall and a door opening, a shelf, said shelf defining an aperture, a race, said race positioned within said aperture and defining a lip extending vertically from said race to be coplanar with said disk, said lip defining a tapered edge for engaging said shelf, said shelf extending across said food storage compartment, a ring with a plurality of finger tabs, said finger tabs attached to said ring and crossing beyond a border and plane defined by said bottom of said shelf for manual manipulation by a user, a rotatable disk, said ring affixed to said disk, said disk rotatably mounted on said race.

2. The refrigerator of claim 1 wherein said shelf further comprises a bearing retainer, a bearing, said bearing positioned on said bearing retainer.

3. The refrigerator of claim 2 wherein said rotatable disk is mounted on said bearing.

4. The refrigerator of claim 2 wherein said race defines an annular groove, said bearing mounted on said annular groove.

5. The refrigerator of claim 2 wherein said plurality of finger tabs extending downwardly from said ring beyond said shelf for manual manipulation by a user.

6. The refrigerator of claim 4 further comprising a shoulder defined by said race, said annular groove positioned between said vertically extended lip and said shoulder.

7. The refrigerator of claim 1 wherein said rotatable disk is formed from glass.

8. The refrigerator of claim 1 wherein said shelf comprises a mounting tab, said mounting tab affixed at one end of said shelf.

9. The refrigerator of claim 1 wherein said shelf defines a central circular aperture.

10. The refrigerator of claim 9 further comprising a circular race, said circular race positioned within said central circular aperture.

11. A refrigerator with a shelf and rotatable disk comprising: a housing, a food storage compartment, said food storage compartment positioned within said housing, said food storage compartment defining opposing side walls, a rear wall and a door opening, a shelf with at least one mounting tab, said mounting tab affixed at one end of said shelf, said shelf defining a central circular aperture, said shelf extending across said food storage compartment, a ring, a rotatable disk, said ring affixed to said rotatable disk, a plurality of finger tabs, said finger tabs attached to said ring, said finger tabs vertically passing beyond and below a plane defined by said bottom of said shelf for manual manipulation by a user, a bearing, a bearing retainer, said bearing positioned on said bearing retainer, said rotatable disk mounted to said bearing, a circular race with an integral lip defining a tapered edge, said lip extending vertically from said race to be generally coplanar with said disk and engaging a top surface of said shelf, said circular race defining an annular groove, said circular race positioned within said central circular aperture, said bearing mounted on said annular groove.

12. The refrigerator of claim 11 wherein said rotatable disk is formed from glass.

13. The refrigerator of claim 11 further comprising a shoulder defined by said race, said annular groove positioned between said vertically extending integral lip and said shoulder, said shoulder positioned more proximate to said tab than said lip.

* * * * *